US006287736B1

(12) United States Patent
Takaki et al.

(10) Patent No.: US 6,287,736 B1
(45) Date of Patent: Sep. 11, 2001

(54) PHOTOSENSITIVE BODY FOR ELECTROPHOTOGRAPHY

(75) Inventors: Ikuo Takaki; Seishi Terasaki, both of Nagano (JP)

(73) Assignee: Fuji Electric Imaging Device Co., Ltd. (JP)

( * ) Notice: Subject to any disclaimer, the term of this patent is extended or adjusted under 35 U.S.C. 154(b) by 0 days.

(21) Appl. No.: 09/641,017

(22) Filed: Aug. 17, 2000

(30) Foreign Application Priority Data

Aug. 26, 1999 (JP) ..... 11-239908

(51) Int. Cl.[7] ..... G03G 5/047
(52) U.S. Cl. ..... 430/58.35; 430/58.4
(58) Field of Search ..... 430/58.4, 58.45, 430/58.85, 58.35, 59.3

(56) References Cited

U.S. PATENT DOCUMENTS 3,977,870 * 8/1976 Rochlitz ..... 430/58.5
4,485,160 * 11/1984 Suzuki et al. ..... 430/58.4
5,258,251 * 11/1993 Hanatani et al. ..... 430/58.4
5,733,696 * 3/1998 Takahashi et al. ..... 430/58.4

* cited by examiner

*Primary Examiner*—John Goodrow

(74) *Attorney, Agent, or Firm*—Morrison Law Firm

(57) ABSTRACT

The present invention provides an organic photosensitive body having improved stability of the electric property at times of repeated use and at times of changes in conditions of environmental usage. Such a photosensitive body prevents the generation of image defects of memory and the like. The present invention is a function-separated laminated organic photosensitive body equipped with a photosensitive layer, having a charge generating layer and a charge transport layer laminated in sequence on top of a conductive substrate, wherein the charge transport layer contains at least one type of electron transporting compound represented by the following general formulas (I) and (II):

(I)

(II)

wherein $R^1$–$R^{29}$, $A^1$, $B^1$, and $B^2$ are each as defined in the specification.

2 Claims, 1 Drawing Sheet

PHOTOSENSITIVE BODY FOR ELECTROPHOTOGRAPHY

BACKGROUND TO THE INVENTION

The present invention relates to a photosensitive body for electrophotography (henceforth referred to as simply "photosensitive body") used in electrophotographic copiers, digital copiers, printers, and the like. More specifically, the present invention relates to a laminated organic photosensitive body, in which the layers have separate functions. This laminated organic photosensitive body is provided with a charge generating layer and a charge transport layer, containing a specified electron transport compound, on a conductive substrate.

An electrophotographic photosensitive body has a basic construction of a photosensitive layer, which has a photoconductive function, laminated on top of a conductive substrate. In recent years, because of its advantages in variety, high productivity, safety, and the like, research and development have been actively conducted in organic electrophotographic photosensitive bodies which use organic compounds as the functional components for generating and transporting charge. There have been advances in their application in copiers and printers.

Photosensitive bodies must have a function for maintaining surface charge in the dark, a function for receiving light and generating charge, and a function for transporting the generated charge. There is what is called a single layer photosensitive body, which is equipped with a single layer photosensitive layer having all of these functions. There is also a function-separated laminated photosensitive body, which is equipped with a photosensitive layer in which layers having separate functions are laminated. The photosensitive layer has a charge generating layer, which mainly has the function of charge generation when receiving light, and a charge transporting layer, which has the function of maintaining surface charge in the dark and of transporting the charge generated in the charge generating layer when receiving light. In recent years, the function-separated laminated organic photosensitive body has become mainstream.

The manufacturing method for this photosensitive body uses organic pigment as the charge generating material. A coating solution, in which this organic pigment is dispersed and dissolved in an organic solvent, together with a resin binder, is coated to form a film to become the charge generating layer. Using an organic low molecular weight compound as the charge transport material, a coating solution, in which this compound together with a resin binder is dissolved in an organic solvent, is coated to form a film to become the charge transport layer. These are laminated to form the photosensitive body.

However, currently, the organic photosensitive body does not always adequately satisfy the desired properties of a photosensitive body. The following various problems have been raised.

First, one of the properties which has been eagerly sought after is an improvement in the stability of the electric property when using repeatedly. Stated more concretely, when the photosensitive body is being continuously and repeatedly used in a real machine, there is fluctuation in the electric potential (particularly the light electric potential), and this invites a deterioration in the copy image quality and print quality. The reasons for such an electronic potential fluctuation include fatigue and deterioration of the organic material due to light, heat, ozone generated with the continuous use inside the real machine, or due to changes in the temperature and humidity conditions of the usage environment.

Furthermore, in real machines such as copiers, digital copiers, printers, and the like, particularly when conducting continuous printing, there can be a so-called memory phenomenon where a developed image can appear in places where there is no printing. This can cause problems as an image defect. Particularly under low temperature/low humidity or high temperature/high humidity conditions, the generation of memory is an important problem that needs to be addressed. With regard to this memory generation, it may be due to the storage in the organic film of charge which is generated during the process of light exposure or charge removal of the photosensitive body, or it may be due to the trapping of charge in the charge transport layer or at the interface of the charge generating layer and the charge transport layer. Currently, there has been progress in improving each of the charge generating material and charge transport material.

These various problems relating to the photosensitive bodies have been studies a great deal, and there have been new proposals, but there is still no means or materials for adequately solving the problems.

OBJECT AND SUMMARY OF THE INVENTION

It is an object of the present invention to provide a photosensitive body for electrophotography which overcomes the foregoing problems.

It is a further object of the present invention to provide a good organic photosensitive body which has improved stability of the electric properties during repeated use and during changes in the usage environment.

It is another object of the present invention to provide an organic photosensitive body which does not generate image disturbances such as memory and the like.

Briefly stated, the present invention relates to an organic photosensitive body having improved stability of the electric property at times of repeated use and at times of changes in conditions of environmental usage. Such a photosensitive body prevents the generation of image defects of memory and the like. The present invention is a function-separated laminated organic photosensitive body equipped with a photosensitive layer, having a charge generating layer and a charge transport layer laminated in sequence on top of a conductive substrate, wherein the charge transport layer contains at least one type of electron transporting compound represented by the following general formulas (I) and (II):

(I)

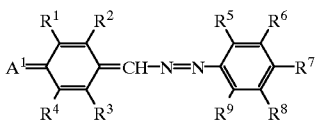

-continued (II)

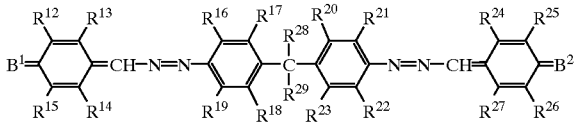

wherein $R^1$–$R^{29}$, $A^1$, $B^1$, and $B^2$ are each as later defined.

According to an embodiment of the present invention, there is provided a photosensitive body for electrophotography, comprising a conductive substrate, a charge generating layer on the conducting substrate, a charge transport layer on the charge generating layer, the charge transport layer having at least one compound represented by the following general formula (I), (I)

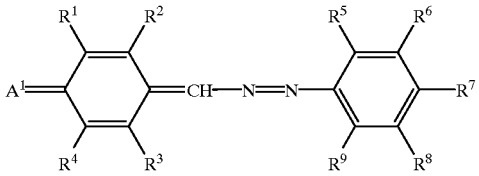

wherein $R^1$–$R^9$ are each independently selected from the group consisting of a hydrogen atom, a halogen atom, a $C_1$–$C_8$ alkyl group, an alkoxy group, a halogenated alkyl group, an aryl alkyl group, a halogenated alkoxy group, or an optionally substituted aryl group, wherein two of more of $R^1$–$R^9$ are optionally joined to form a ring, $A^1$ represents an oxygen atom or a $CR^{10}R^{11}$ group wherein $R^{10}$ and $R^{11}$ each independently represent a cyano group or an alkoxycarbonyl group.

According to another embodiment of the present invention, there is provided a photosensitive body for electrophotography, comprising a conductive substrate, a charge generating layer on the conducting substrate, a charge transport layer on the charge generating layer, the charge transport layer having at least one compound represented by the following general formula (II), wherein $R^{12}$–$R^{29}$ are each independently selected from the group consisting of a hydrogen atom, a halogen atom, a $C_1$–$C_8$ alkyl group, an alkoxy group, a halogenated alkyl group, an aryl alkyl group, a halogenated alkoxy group, or an optionally substituted aryl group, wherein two of more of $R^{12}$–$R^{29}$ are optionally joined to form a ring, $B^1$ and $B^2$ each independently represent an oxygen atom or a $CR^{30}R^{31}$ group, wherein $R^{30}$ and $R^{31}$ each independently represents a cyano group or an alkoxycarbonyl group.

The above, and other objects, features, and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
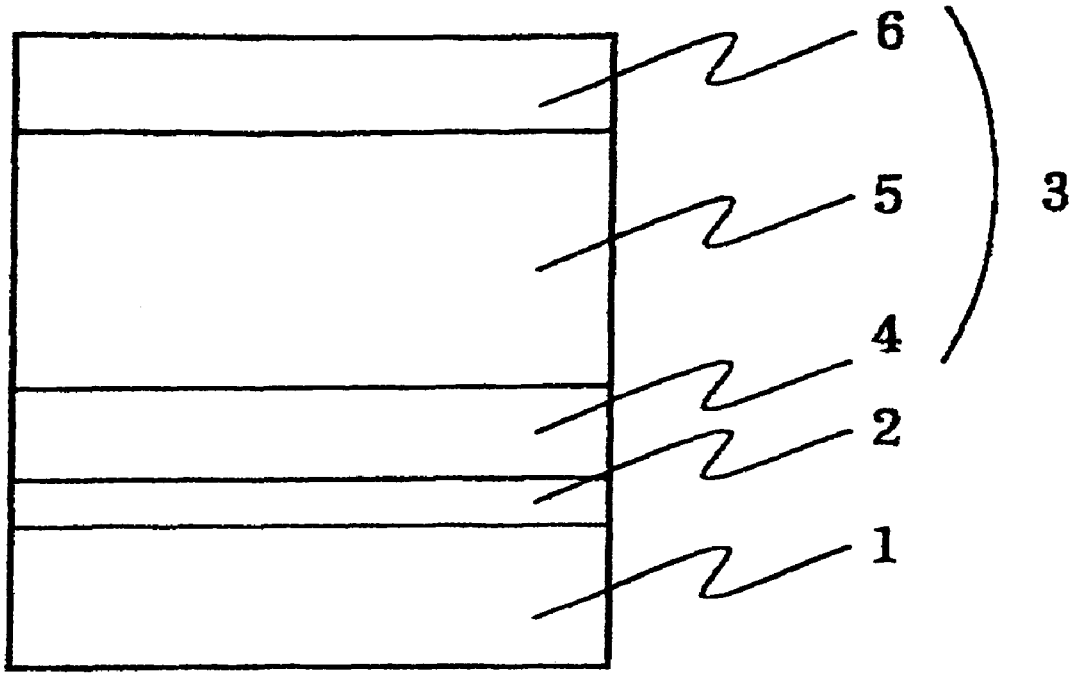
FIG. 1 is a model cross-sectional diagram showing a construction example of the photosensitive body of the present invention.

Concrete examples for the above general formulas (I) and (II) are given by the following (I-1)~(I-16) and (II-1)~(II-8), respectively, but the present invention is not limited to these.

(II)

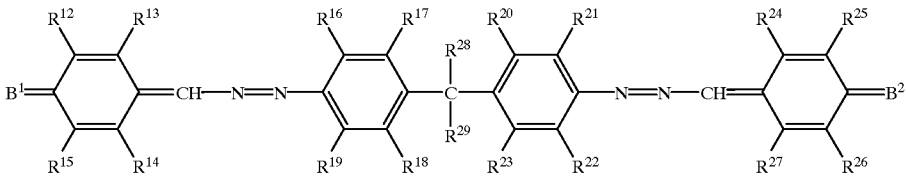

(I-1)
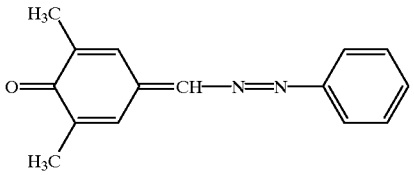
(I-2)
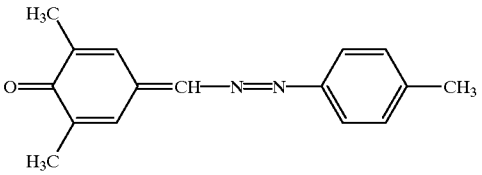
(I-3)
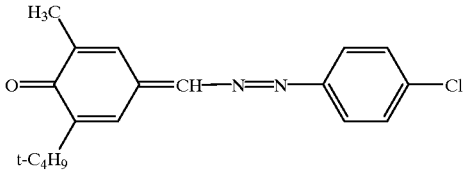
(I-4)
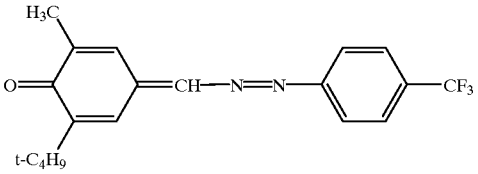
(I-5)
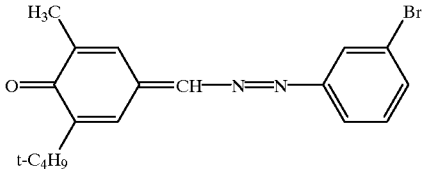
(I-6)
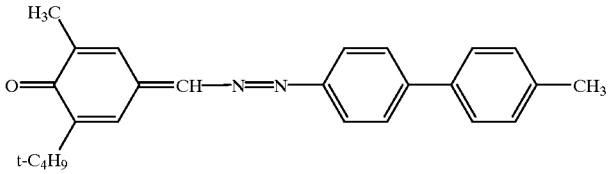
(I-7)
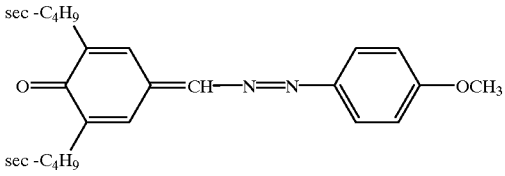
(I-8)
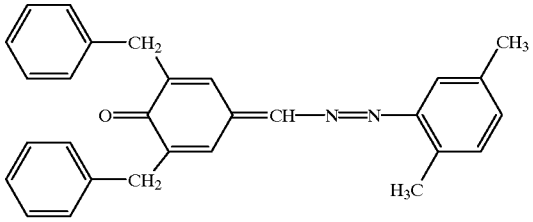
(I-9)
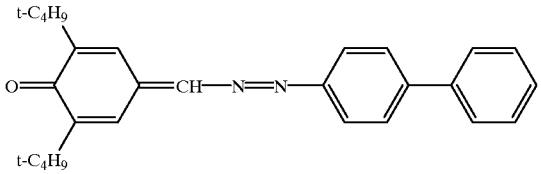
(I-10)
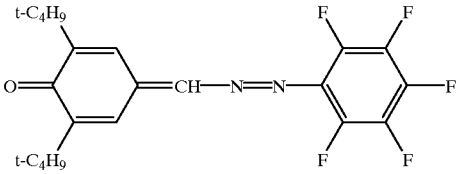
(I-11)
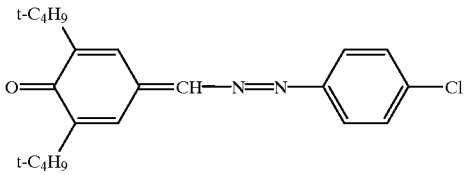
(I-12)
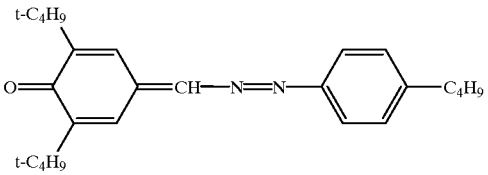
(I-13)
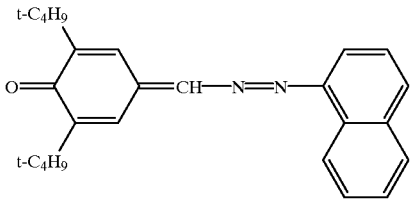
(I-14)
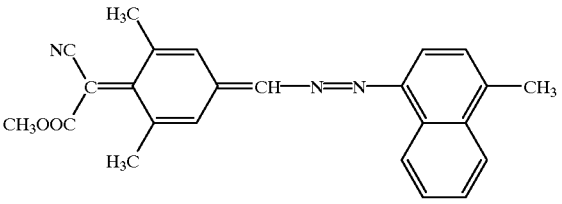

-continued
(I-15)
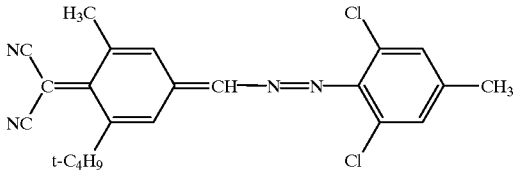
(I-16)
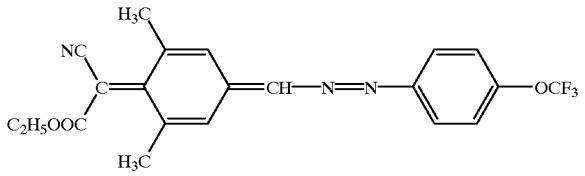
(II-1)
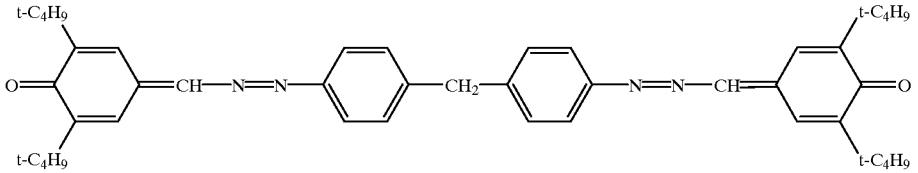
(II-2)
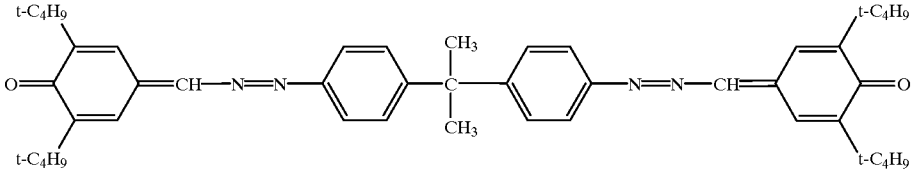
(II-3)
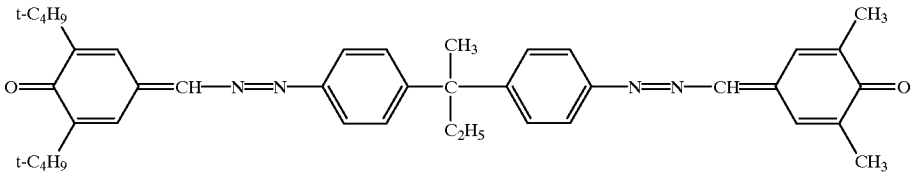
(II-4)
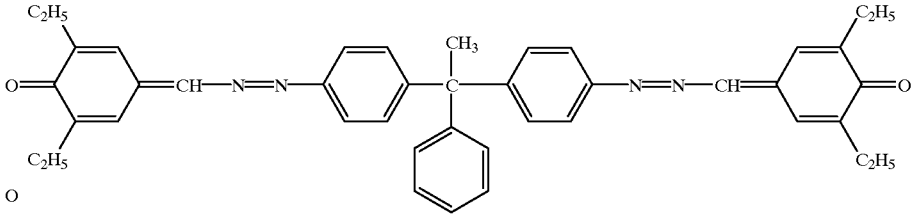
(II-5)
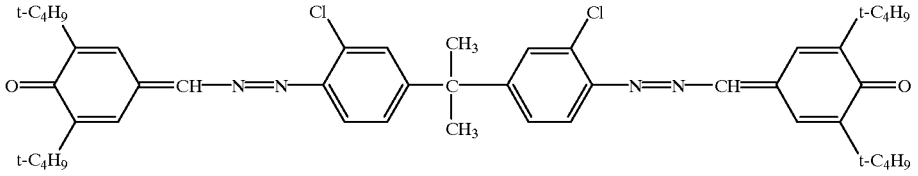
(II-6)
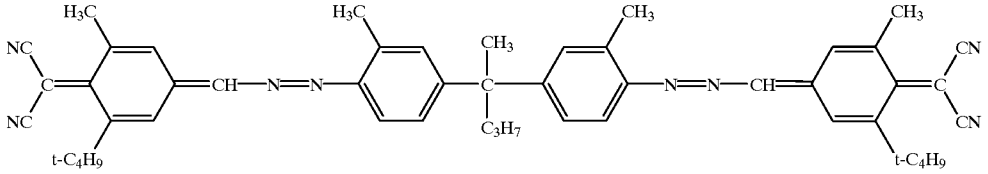

-continued (II-7)

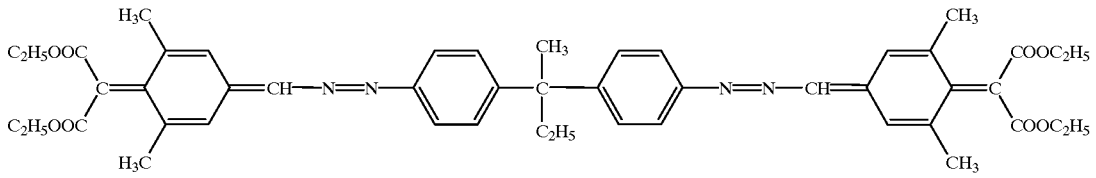

(II-8)

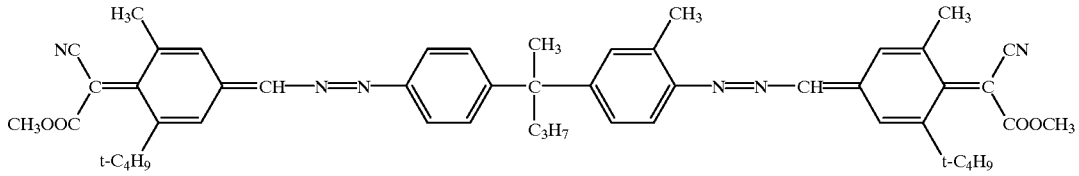

Referring to FIG. 1, there is shown a model cross-sectional diagram showing one construction example of the photosensitive body of the present invention. The present invention is preferably a function separated laminated organic photosensitive body with a construction in which a photosensitive layer 3 of a charge generating layer 4, a charge transport layer 5, and a surface protective layer 6, are sequentially laminated on top of a conductive substrate 1 via an undercoating 2.

Conductive substrate 1 acts simultaneously as an electrode for the photosensitive body and as a support body for each layer constructing the photosensitive body. It can be any shape such as cylindrical, board-like, fihn-like, and the like. In terms of material, it can be a metal such as aluminum, stainless steel, nickel, and the like, or a material in which the surface of glass, resin and the ilike has been provided with conductive treatment.

Undercoating layer 2 includes a layer which has resin as its main component and a metal oxide coating such as anodized aluminum and the like. It is created according to the needs of the objectives, such as control of injection of charge from the conductive substrate to the photosensitive layer, covering of defects of the substrate surface, improving the adhesion between the photosensitive layer and the bottom layer, and the like. Preferred resin materials for the undercoating layer include insulating polymers such as casein resin, polyvinyl alcohol resin, polyamide resin, melamine resin, cellulose resin, and the like, and conductive polymers such as polythiophene, polypyrrole, polyaniline, and the like. These resins can be used singly or can be combined and mixed as appropriate. Furthermore, these resins can also contain metal oxides such as titanium dioxide or zinc oxide, and the like.

As described previously, charge generating layer 4 can be formed by coating with a coating solution in which particles of charge generating material is dispersed in a resin binder, or by vacuum deposition method. Charge generating layer 4 generates charge by receiving light. The charge generating efficiency as well as the injectability of the generated charge to charge transport layer 5 are very important. It is desirable to have little electric field dependence and to have good injection even at low electric fields.

As the charge generating material, phthalocyanine compounds such as X non-metal phthalocyanine, tau non-metal phthalocyanine, alpha titanyl phthalocyanine, beta titanyl phthalocyanine, Y titanyl phthalocyanine, amorphous titanyl phthalocyanine, eta copper phthalocyanine, and the like, various azo pigments, anthoanthrone pigment, thiapyrylium pigment, perylene pigment, perynone pigment, squarylium pigment, quinacridone pigment, and the like can be used singly or can be combined appropriately, or else selenium or selenium compounds and the like can also be used. A suitable material can be selected according to the light wavelength region of the light exposure light source used in image formation.

The charge generating layer needs to have a charge generating function. The film thickness is determined by the light absorption coefficient of the charge generating material. Generally, it is 1 micrometers or less. Ideally, it is 0.5 micrometers or less. The charge generating layer is mainly the charge generating material, and charge transporting material and the like can also be added.

As the resin binder for the charge generating layer, polymers and copolymers and the like of polycarbonate resin, polyester resin, polyamide resin, polyurethane resin, vinyl chloride resin, vinyl acetate resin, phenoxy resin, polyvinyl acetal resin, polyvinyl butyral resin, polystyrene resin, polysulfone resin, diallylphthalate resin, ester methacrylate resin can be appropriately combined and used.

Charge transport layer 5 is mainly constructed from charge transporting material and resin binder. As the charge transport material, various hydrazone compounds, styryl compounds, diamine compounds, butadiene compounds, indole compounds and the like can be used singly or can be combined and mixed appropriately.

The following (III-1~(III-14) represent examples of charge transport materials which can be used for the present invention.

(III-1)
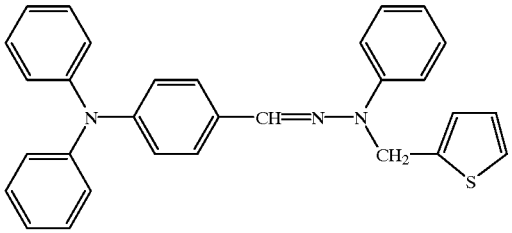
(III-2)
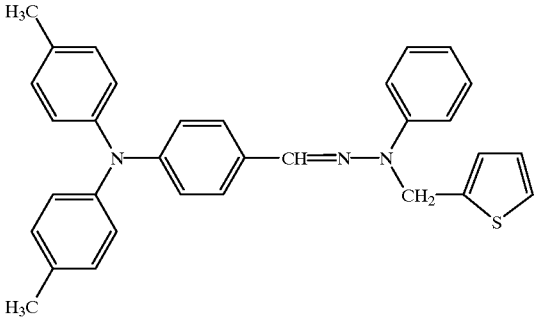
(III-3)
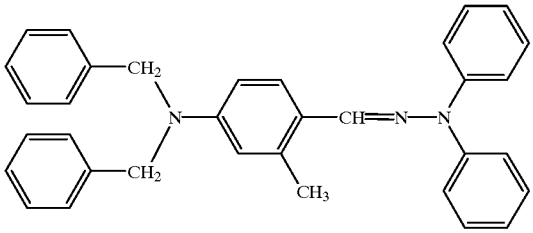
(III-4)
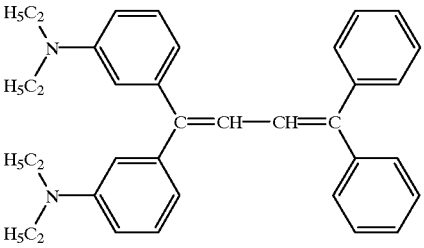
(III-5)
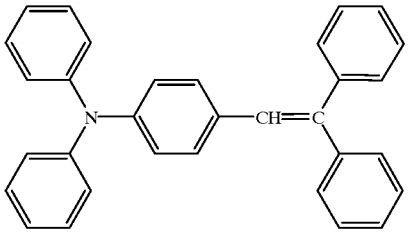
(III-6)
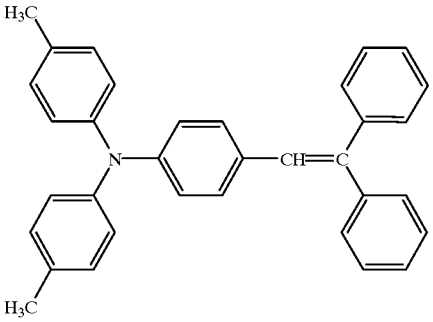
(III-7)
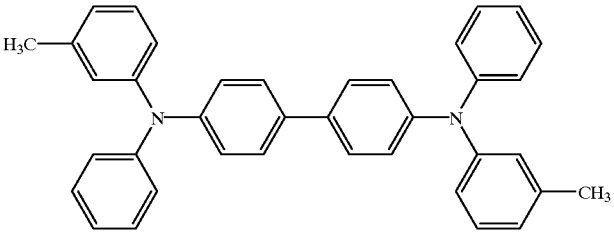
(III-8)
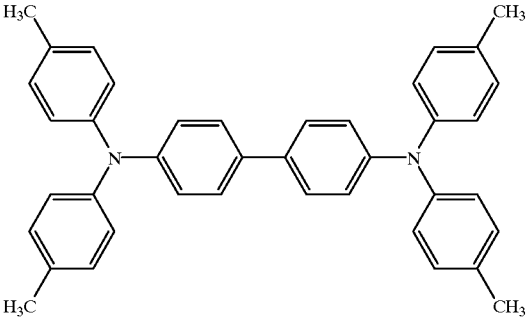
(III-9)
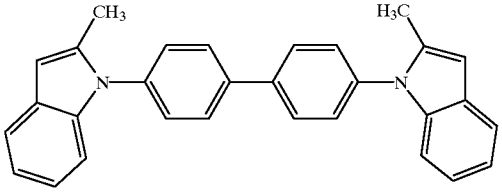

-continued (III-10)

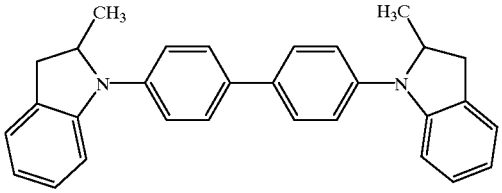

(III-11)

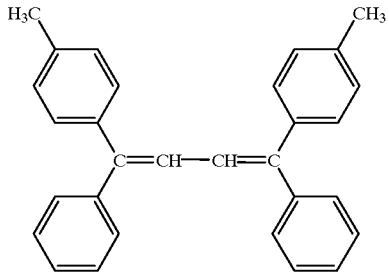

(III-12)

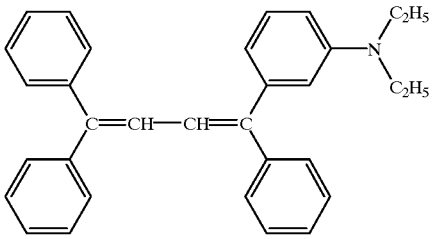

(III-13)

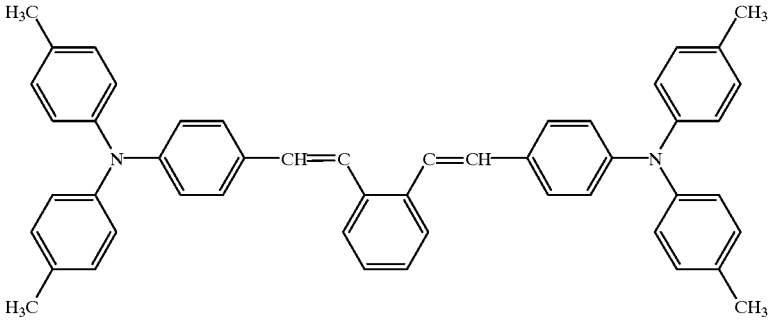

(III-14)

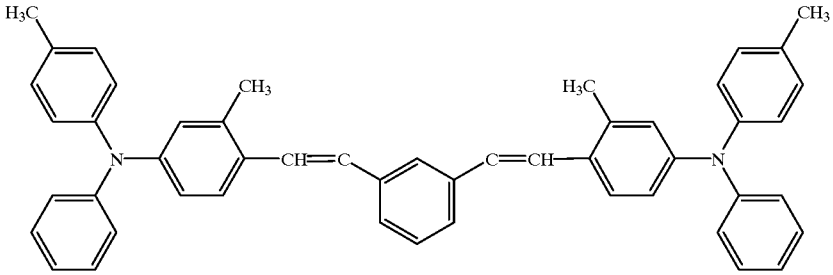

For the resin binder used for the charge transport layer, polycarbonate resins such as bis phenol A, bis phenol Z, bis phenol A-biphenyl copolymer, and the like, polystyrene resins, polyphenylene resins, and the like can be used singly or can be combined and mixed as appropriate. For every 100 weight parts of resin binder, the usage amount of these compounds is 2–50 weight parts of charge transport material, and ideally 3–30 weight parts. Furthermore, for the film thickness of the charge transport layer, in order to maintain a practical and effective surface potential, a film thickness in the range of 3–50 micrometers is preferable, and 15–40 micrometers is more preferable.

Furthermore, for the purposes of improving sensitivity, reducing residual electric potential, improving environmental resistance, and improving stability with respect to harmful light, and the like, various additives can be added as needed to the undercoating layer, charge generating layer, and charge transport layer. In the present invention, at least one type of electron transporting compound represented by the previous general formulas (I) or (II) must be added to the charge transport layer, but electron receiving substances and electron transporting substances, such as succinic anhydride, maleic anhydride, dibromosuccinic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, trinitrofluorenone, and the like, may also be used.

Furthermore, as the above additive, anti-oxidants and light stabilizers and the like may also be added. Compounds which can be used for these purposes include chromal derivatives such as tocopherol and the like, etherized compounds, esterized compounds, polyaryl alkanized compounds, hydroquinone derivatives, dietherized compounds, benzophenone derivatives, benzotriazole derivatives, thioether compounds, phenylene diamine derivatives, ester phosphonate, ester phosphite, phenol compounds, hindered phenol compounds, straight chain amine compounds, cyclic amine compounds, hindered amine compounds and the like. However, it is not limited to these.

Furthermore, for the purposes of improving leveling of the formed film and for contributing to further lubrication, leveling agents such as silicone oil or fluorine oils and the like can be added to the photosensitive layer.

For the purposes of improving environmental resistance and mechanical strength, there can be a surface protection layer 6 on the photosensitive layer surface as needed. Surface protection layer 6 should be constructed from material with excellent resistance with respect to mechanical stress and excellent environmental resistance. Surface protection layer 6 preferably is capable of transmitting the light to be sensed by the charge generating layer with as minimal a loss as possible.

Surface protection layer 6 has a layer with a resin binder as the main component, and an inorganic thin film of amorphous carbon, and the like. Furthermore, for the purposes of improving conductivity, reducing the friction coefficient, and contributing to the lubrication, the resin binder can contain metal oxides such as silicon oxide (silica), titanium oxide, zinc oxide, calcium oxide, aluminum oxide (alumina), zirconium oxide, and the like; metal sulfates such as barium sulfate, calcium sulfate, and the like; metal nitrides, such as silicon nitride, aluminum nitride, and the like; fme particles of metal oxides; or particles of fluorine resins such as tetrafluoroethylene resin, and the like, and fluorine comb-type graft polymer resins, and the like.

Furthermore, for the purposes of contributing to the charge transportation, charge transporting substances or electron receiving substances used in the above photosensitive layer or the electron transporting substances and the like of the present invention can be added to surface protection layer 6. For the purposes of improving the leveling of the formed film or for contributing to the lubrication, leveling agents such as silicone oil or fluorine oil and the like can also be added to surface protection layer 6.

The film thickness of surface protection layer 6 depends on the mixed composition, any suitable thickness can be selected as long as it is within the range where there is no negative effect, such as residual electric potential with repeated continuous use.

Furthermore, the organic photosensitive body containing the electron transporting compound of the present invention achieves the previously described advantages by using various machine processes. Stated more concretely, a sufficient effect is exhibited with charging processes having non-contact charging methods which uses corotron or scorotron, or development processes with contact development method and non-contact development methods of non-magnetic single component, magnetic single component, two component development, and the like.

Based on embodiments, the present invention will be described in detail below.

Embodiment 1

A coating solution, in which 5 weight parts of alcohol soluble nylon (Amilan CM 8000, manufactured by Toray Industries, Inc.) and 5 weight parts of aminosilane treated titanium oxide fine particles are dissolved and dispersed in 90 weight parts of methanol, was prepared. The outer perimeter of an aluminum cylinder as the conductive substrate was immersion coated in this coating solution. This was dried for 30 minutes at a temperature of 100 degrees C., and an undercoating layer of film thickness approximately 2 micrometers was formed.

A coating solution, in which 1.5 weight parts of X type non-metal phthalocyanine as the charge generating material and 1.5 weight parts ofpolyvinyl butyral resin (S-LEC BX-1, manufactured by Sekisui Chemical Co. Ltd.) as the resin binder was dispersed and dissolved in 60 weight parts of a mixture of equal parts dichloromethane and dichloroethane, was prepared. Immersion coating with this coating solution was conducted on top of the undercoating layer. This was dried for 30 minutes at a temperature of 80 degrees C., and a charge generating layer of film thickness approximately 0.3 micrometers was formed.

A coating solution, in which 100 weight parts of the compound represented by the previous structural formula (III-8) as the charge transporting material and 100 weight parts of a polycarbonate resin (Toughzet B-500, manufactured by Idemitsu Kosan Corp. Ltd.) as the resin binder and 1 weight part of an electron transporting compound represented by the previous structural formula (I-1) was dissolved in 900 weight parts ofdichloromethane, was prepared. This coating solution was coated to form a film on top of the charge generating layer. This was dried for 60 minutes at a temperature of 90 degrees C. A charge transport layer with a film thickness of approximately 25 micrometers was formed, and an organic photosensitive body was created.

Embodiment 2

An organic photosensitive body was created by the same method as Embodiment 1, except that the electron transporting compound used in Embodiment 1 was replaced with a compound represented by the previous structural formula (I-11).

Embodiment 3

An organic photosensitive body was created by the same method as Embodiment 1, except that the charge transporting material used in Embodiment 1 was replaced with a compound represented by the previous structural formula (III-5).

Embodiment 4

An organic photosensitive body was created by the same method as Embodiment 1, except that the electron transporting compound used in Embodiment 1 was replaced with a compound represented by the previous structural formula (I-11) and the charge transport material was replaced with (III-5).

Embodiment 5

An organic photosensitive body was created by the same method as Embodiment 1, except that the charge transporting material used in Embodiment 1 was replaced with a compound represented by the previous structural formula (III-11).

Embodiment 6

An organic photosensitive body was created by the same method as Embodiment 1, except that the charge generating material used in Embodiment 1 was replaced with alpha-type oxytitanyl phthalocyanine.

COMPARATIVE EXAMPLE 1

An organic photosensitive body was created by the same method as Embodiment 1, except that the electron transporting compound used in Embodiment 1 was not used.

COMPARATIVE EXAMPLE 2

An organic photosensitive body was created by the same method as Embodiment 3, except that the electron transporting compound used in Embodiment 3 was not used.

The electrophotography property of the photosensitive bodies manufactured in the above Embodiments 1–6 and Comparative examples 1 and 2 were evaluated by the following method. First, the photosensitive body surface was charged to −650 V by a corona discharge in the dark. Next, the surface potential $V_0$ immediately after charging was measured. Next, after leaving the corona discharge in the dark for 5 seconds, the surface potential $V_5$ was measured. The potential maintenance rate $V_{k5}$ (%) at 5 seconds after charging was obtained according to the following formula.

$$V_{k5}=V_5/V_0\times 100$$

Next, using a halogen lamp as the light source, and with an exposure light which has been separated to 780 nm using a filter, the photosensitive body was irradiated for 5 seconds from the time the surface potential reaches −600 V. Light sensitivity $E_{100}$ (microJcm$^{-2}$) is the light exposure amount needed for light attenuation until the surface potential becomes −100 V.

Referring to Table 1, the electrical properties of the photosensitive bodies created in Embodiments 1–6 and Comparative examples 1,2 are shown as these measurement results.

TABLE 1

| | $V_{k5}$/% | $E_{100}$/microJcm$^{-2}$ |
|---|---|---|
| Embodiment 1 | 96.4 | 0.57 |
| Embodiment 2 | 97.2 | 0.65 |
| Bmbodiment 3 | 95.9 | 0.64 |
| Embodiment 4 | 96.3 | 0.70 |
| Embodiment 5 | 96.0 | 0.73 |
| Embodiment 6 | 95.8 | 0.25 |

TABLE 1-continued

| | $V_{k5}$/% | $E_{100}$/microJcm$^{-2}$ |
|---|---|---|
| Comparative example 1 | 96.0 | 0.59 |
| Comparative example 2 | 95.8 | 0.63 |

From the results of the above Table 1, it is clear that there is no large change in the electrical properties between when the electron transport materials of the present invention is added to the charge transport layer and when it is not added.

Next, the photosensitive bodies were mounted onto a magnetic two component development method digital copier which had been modified to allow measurement of the surface potential of the photosensitive body. Evaluations of the stability of the potential at the start and after repeated printing of 100,000 pages and evaluation of the image memory was conducted. These results are shown in the following Table 2.

TABLE 2

| | Initial potential in light (V) | Evaluation of initial image memory | Potential in light after 100,000 copies (V) | Amount of change of potential in light (V) | Image memory after repeated printing |
|---|---|---|---|---|---|
| Emb. 1 | 66 | O | 67 | 1 | O |
| Emb. 2 | 62 | O | 66 | 4 | O |
| Emb. 3 | 70 | O | 73 | 3 | O |
| Emb. 4 | 69 | O | 71 | 2 | O |
| Emb. 5 | 66 | O | 73 | 7 | O |
| Emb. 6 | 45 | O | 47 | 2 | O |
| Comp. ex. 1 | 68 | O | 90 | 22 | X (pos.) |
| Comp. ex. 2 | 62 | O | 85 | 23 | X (pos.) |

In the image sample, there is a checker flag pattern in the first half of the scanner sweep, and in the latter half there is a halftone. The image memory evaluation of Table 2 interprets the memory phenomenon in which the halftone portion is seen in the checker flag. When there is no memory, the evaluation is indicated as O, and if memory is observed, it is indicated as X. If the density is the same as in the original image it is indicated as (pos.), if the image appears as having a reverse density of the original image, it is indicated as (neg.).

From the results in the above Table 2, there is not a large difference in the initial electric properties in a real machine. However, for the potential and image evaluations after repeated printings of 100,000 pages, by adding the electron transporting compound of the present invention to the charge transport layer, there is a large difference compared to ones in which it is not added. It is clear that the rise in residual potential and the worsening of the image memory can be sufficiently reduced.

In addition, the stability of the potential and image memory were evaluated when the usage environment of the copier was changed. These results are shown in Table 3.

TABLE 3

| | Low temp./ low humidity * 1 (V) | Normal temp./ normal humidity *2 (V) | High temp./ high humidity *3 (V) | Amount change of residual potential between low temp./ low hum. and high temp./high hum. (V) | Memory evaluation at high temp/high humidity | Memory evaluation at low temp/low humidity |
|---|---|---|---|---|---|---|
| Emb. 1 | 96 | 66 | 51 | 45 | O | O |
| Emb. 2 | 97 | 62 | 50 | 47 | O | O |
| Emb. 3 | 90 | 70 | 44 | 46 | O | O |
| Emb. 4 | 93 | 69 | 43 | 50 | O | O |
| Emb. 5 | 92 | 66 | 49 | 43 | O | O |
| Emb. 6 | 76 | 45 | 33 | 43 | O | O |
| Comp. ex. 1 | 118 | 68 | 39 | 79 | X (pos.) | X (neg.) |
| Comp. ex. 2 | 125 | 62 | 34 | 91 | X (pos.) | X (neg.) |

*1: temperature 5 degrees C., humidity 10%;
*2: temperature 25 degrees C., humidity 60%;
*3: temperature 35 degrees C., humidity 90%

From the results from the above Table 3, it is clear that by adding the electron transporting compound of the present invention to the charge transport layer, the dependence of the potential and the image on the environment is smaller.

According to the present invention, by adding an electron transporting compound with a specified construction to the charge transport layer, a function-separated laminated organic photosensitive body, in which there is electrical stability in the initial period, when used repeatedly, and when the usage environmental conditions are changed, is provided. Under each of these conditions, image defects such as image memory and the like are not generated.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A photosensitive body for electrophotography, comprising:

a conductive substrate;

a charge generating layer on said conducting substrate;

a charge transport layer on said charge generating layer;

said charge transport layer having at least one compound represented by the following general formula (I), (I)

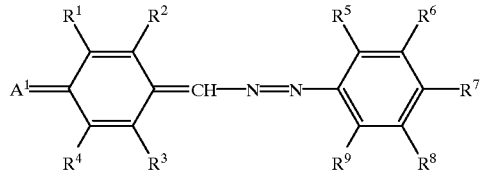

wherein $R^1$–$R^9$ are each independently selected from the group consisting of a hydrogen atom, a halogen atom, a $C_1$–$C_8$ alkyl group, an alkoxy group, a halogenated alkyl group, an aryl alkyl group, a halogenated alkoxy group, or an optionally substituted aryl group, wherein two of more of $R^1$–$R^9$ are optionally joined to form a ring, $A^1$ represents an oxygen atom or a $CR^{10}R^{11}$ group wherein $R^{10}$ and $R^{11}$ each independently represent a cyano group or an alkoxycarbonyl group.

2. A photosensitive body for electrophotography, comprising:

a conductive substrate;

a charge generating layer on said conducting substrate;

a charge transport layer on said charge generating layer;

said charge transport layer having at least one compound represented by the following general formula (II), (II)

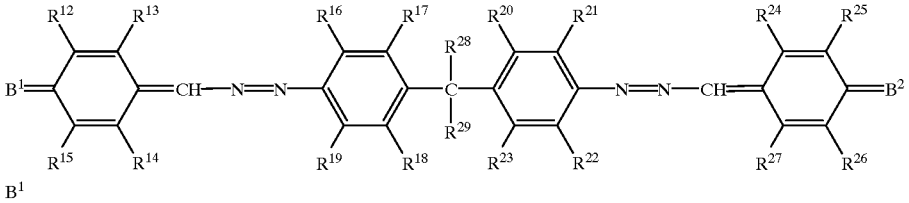

$B^1$ wherein $R^{12}$–$R^{29}$ are each independently selected from the group consisting of a hydrogen atom, a halogen atom, a $C_1$–$C_8$ alkyl group, an alkoxy group, a halogenated alkyl group, an aryl alkyl group, a halogenated alkoxy group, or an optionally substituted aryl group, wherein two of more of $R^{12}$–$R^{29}$ are optionally joined to form a ring, $B^1$ and $B^2$ each independently represent an oxygen atom or a $CR^{30}R^{31}$ group, wherein $R^{30}$ and $R^{31}$ each independently represents a cyano group or an alkoxycarbonyl group.

* * * * *